US007953362B2

(12) United States Patent
Arai et al.

(10) Patent No.: US 7,953,362 B2
(45) Date of Patent: May 31, 2011

(54) IMAGE FORMING APPARATUS, PROCESS CARTRIDGE, AND LUBRICANT APPLICATOR

(75) Inventors: Yuji Arai, Kawasaki (JP); Hiroyuki Nagashima, Yokohama (JP); Nobuo Kuwabara, Yokohama (JP); Hirotaka Hatta, Kawasaki (JP); Hiroshi Hosokawa, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 1130 days.

(21) Appl. No.: 11/679,010

(22) Filed: Feb. 26, 2007

(65) Prior Publication Data

US 2007/0209877 A1 Sep. 13, 2007

(30) Foreign Application Priority Data

Feb. 27, 2006 (JP) ..... 2006-050211

(51) Int. Cl.
*G03G 21/00* (2006.01)

(52) U.S. Cl. ..... 399/346

(58) Field of Classification Search ..... 399/346; 430/126.2

See application file for complete search history.

(56) References Cited

U.S. PATENT DOCUMENTS

| | | | | |
|---|---|---|---|---|
| 2005/0025520 | A1* | 2/2005 | Murakami et al. | 399/111 |
| 2005/0238384 | A1 | 10/2005 | Sampe et al. | |
| 2006/0018680 | A1 | 1/2006 | Hosokawa et al. | |
| 2006/0194662 | A1 | 8/2006 | Hozumi et al. | |

FOREIGN PATENT DOCUMENTS

| | | |
|---|---|---|
| JP | 2000-231298 | 8/2000 |
| JP | 2005-140875 | 6/2005 |
| JP | 2005-195720 | 7/2005 |
| JP | 2005208431 A * | 8/2005 |
| JP | 2005-321833 | 11/2005 |

OTHER PUBLICATIONS

Machine Translation of JP 2005-195720—JP 2005-195720 cited by Applicant in IDS dated Feb. 26, 2007 and provided with English Abstract.*

English Abstract of JP 2005208431A cited above, published Aug. 2005.*

Machine Translation of JP 2005208431A cited above, published Aug. 2005.*

U.S. Appl. No. 12/046,827, filed Mar. 12, 2008, Ono, et al.

* cited by examiner

*Primary Examiner* — David P Porta
*Assistant Examiner* — Bryan P Ready
(74) *Attorney, Agent, or Firm* — Oblon, Spivak, McClelland, Maier & Neustadt, L.L.P.

(57) ABSTRACT

An image forming apparatus includes a photoconductor and a lubricant applicator. The photoconductor carries a toner image formed by developing an electrostatic latent image with a toner. The lubricant applicator applies a solid lubricant to a surface of the photoconductor, and includes a brush roller, a holder, a pressing member, and a protrusion. The holder holds the solid lubricant. The brush roller scrapes off the solid lubricant from the holder and applies the scraped solid lubricant to the surface of the photoconductor. The pressing member has an ellipse shape and presses the solid lubricant toward the brush roller via the holder. The protrusion is disposed on the holder and contacts an inner circumferential surface of the pressing member at two positions provided in both end portions of the pressing member in a direction of a minor axis of the ellipse formed by the pressing member to support the pressing member.

16 Claims, 8 Drawing Sheets

IMAGE FORMING APPARATUS, PROCESS CARTRIDGE, AND LUBRICANT APPLICATOR

CROSS-REFERENCE TO RELATED APPLICATION

The present application is based on and claims priority to Japanese patent application No. 2006-050211 filed on Feb. 27, 2006 in the Japan Patent Office, the entire contents of which are hereby incorporated herein by reference.

BACKGROUND OF THE INVENTION

1. Field of the Invention

Exemplary aspects of the present invention relate to an image forming apparatus, a process cartridge, and a lubricant applicator, and more particularly to an image forming apparatus, a process cartridge, and a lubricant applicator for applying a lubricant on a surface of a photoconductor.

2. Description of the Related Art

A related art image forming apparatus, such as a copying machine, a facsimile machine, a printer, or a multifunction printer having copying, printing, scanning, and facsimile functions, forms an electrostatic latent image on a photoconductor according to image data. The electrostatic latent image is developed with a developer (e.g., a toner) to form a toner image on the photoconductor. The toner image is transferred from the photoconductor onto an intermediate transfer member and is further transferred onto a recording medium (e.g., a sheet). A fixing unit applies heat and pressure to the sheet bearing the toner image to fix the toner image on the sheet. Thus, the toner image is formed on the sheet.

After the toner image formed on the photoconductor is transferred onto the intermediate transfer member, a brush roller applies a solid lubricant to the surface of the photoconductor. For example, a spring applies pressure to the solid lubricant toward the brush roller. The brush roller scrapes the solid lubricant and applies the scraped solid lubricant to the surface of the photoconductor. The spring may preferably have a small spring constant, so that the pressure applied to the solid lubricant does not substantially vary.

One example of the spring having a small spring constant has an ellipse shape so as to occupy less space. The spring is attached to a holder for holding the solid lubricant. However, the spring may not be easily attached when the inner diameter of the spring varies.

BRIEF SUMMARY OF THE INVENTION

This specification describes below an image forming apparatus according to an exemplary embodiment of the present invention. In one exemplary embodiment of the present invention, the image forming apparatus includes a photoconductor and a lubricant applicator. The photoconductor carries a toner image formed by developing an electrostatic latent image with a toner. The lubricant applicator applies a solid lubricant to a surface of the photoconductor. The lubricant applicator includes a brush roller, a holder, a pressing member, and a protrusion. The holder holds the solid lubricant. The brush roller scrapes off the solid lubricant from the holder and applies the scraped solid lubricant to the surface of the photoconductor. The pressing member has an ellipse shape and presses the solid lubricant toward the brush roller via the holder. The protrusion is disposed on the holder and contacts an inner circumferential surface of the pressing member at two positions provided in both end portions of the pressing member in a direction of a minor axis of the ellipse formed by the pressing member so as to support the pressing member.

This specification further describes below a process cartridge according to an exemplary embodiment of the present invention. In one exemplary embodiment of the present invention, the process cartridge includes a photoconductor and a lubricant applicator. The photoconductor carries a toner image formed by developing an electrostatic latent image with a toner. The lubricant applicator applies a solid lubricant to a surface of the photoconductor. The lubricant applicator includes a brush roller, a holder, a pressing member, and a protrusion. The holder holds the solid lubricant. The brush roller scrapes off the solid lubricant from the holder and applies the scraped solid lubricant to the surface of the photoconductor. The pressing member has an ellipse shape and presses the solid lubricant toward the brush roller via the holder. The protrusion is disposed on the holder and contacts an inner circumferential surface of the pressing member at two positions provided in both end portions of the pressing member in a direction of a minor axis of the ellipse formed by the pressing member so as to support the pressing member.

This specification further describes below a lubricant applicator for applying a solid lubricant to a surface of a photoconductor according to an exemplary embodiment of the present invention. In one exemplary embodiment of the present invention, the lubricant applicator includes a brush roller, a holder, a pressing member, and a protrusion. The holder holds the solid lubricant. The brush roller scrapes off the solid lubricant from the holder and applies the scraped solid lubricant to the surface of the photoconductor. The pressing member has an ellipse shape and presses the solid lubricant toward the brush roller via the holder. The protrusion is disposed on the holder and contacts an inner circumferential surface of the pressing member at two positions provided in both end portions of the pressing member in a direction of a minor axis of the ellipse formed by the pressing member so as to support the pressing member.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
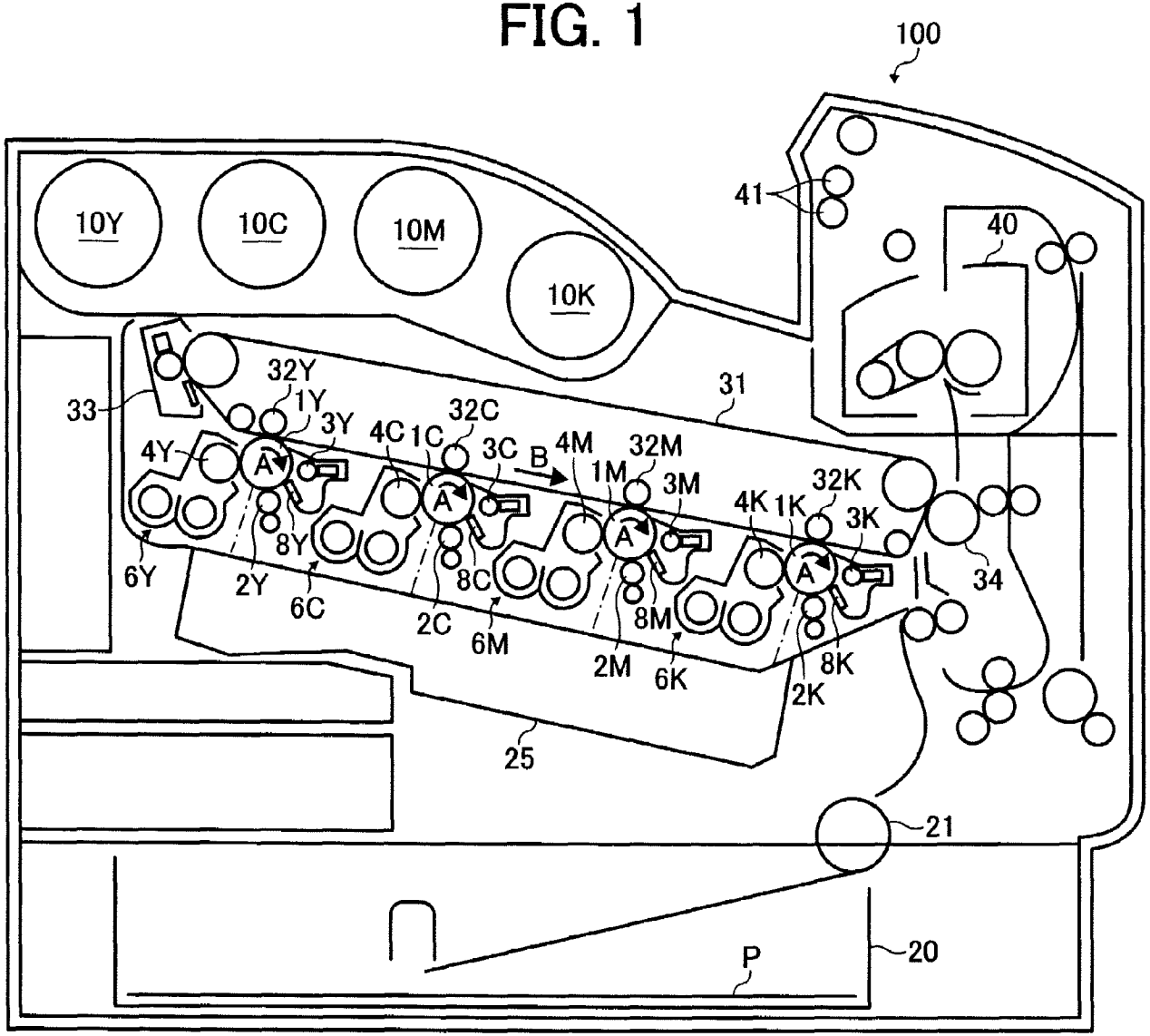
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

As illustrated in FIG. 1, the image forming apparatus 100 includes image forming units 6Y, 6C, 6M, and 6K, an optical writer 25, toner bottles 10Y, 10C, 10M, and 10K, an intermediate transfer belt 31, first transfer rollers 32Y, 32C, 32M, and 32K, a cleaner 33, a paper tray 20, a feeding roller 21, a second transfer roller 34, a fixing unit 40, and an output roller pair 41.

The image forming unit 6Y includes a photoconductor 1Y, a charger 2Y, a development unit 4Y, a lubricant applicator 3Y, and a cleaner 8Y. The image forming unit 6C includes a photoconductor 1C, a charger 2C, a development unit 4C, a lubricant applicator 3C, and a cleaner 8C. The image forming unit 6M includes a photoconductor 1M, a charger 2M, a development unit 4M, a lubricant applicator 3M, and a cleaner 8M. The image forming unit 6K includes a photoconductor 1K, a charger 2K, a development unit 4K, a lubricant applicator 3K, and a cleaner 8K.

The image forming apparatus 100 can be a copying machine, a facsimile machine, a printer, a multifunction printer having copying, printing, scanning, and facsimile functions, or the like. According to this non-limiting exemplary embodiment of the present invention, the image forming apparatus 100 functions as a color printer for printing a color image on a recording medium by an electrophotographic method.

The image forming units 6Y, 6C, 6M, and 6K, serving as process cartridges, form toner images in yellow, cyan, magenta, and black colors, respectively. The image forming units 6Y, 6C, 6M, and 6K are attachable to and detachable from the image forming apparatus 100. The image forming units 6Y, 6C, 6M, and 6K use toners of different colors from each other as a developer, but have a common structure.

The photoconductors 1Y, 1C, 1M, and 1K have a drum shape and serve as an image carrier. The photoconductors 1Y, 1C, 1M, and 1K rotate in a rotating direction A and contact the intermediate transfer belt 31. The chargers 2Y, 2C, 2M, and 2K, the development units 4Y, 4C, 4M, and 4K, the lubricant applicators 3Y, 3C, 3M, and 3K, and the cleaners 8Y, 8C, 8M, and 8K are disposed around the photoconductors 1Y, 1C, 1M, and 1K, respectively. The chargers 2Y, 2C, 2M, and 2K uniformly charge surfaces of the photoconductors 1Y, 1C, 1M, and 1K, respectively.

The optical writer 25 emits light (e.g., a laser beam) onto each of the charged surfaces of the photoconductors 1Y, 1C, 1M, and 1K according to image data. Thus, electrostatic latent images corresponding to yellow, cyan, magenta, and black image data are formed on the surfaces of the photoconductors 1Y, 1C, 1M, and 1K, respectively.

The toner bottles 10Y, 10C, 10M, and 10K contain yellow, cyan, magenta, and black toners, respectively. The yellow, cyan, magenta, and black toners in a predetermined amount are supplied from the toner bottles 10Y, 10C, 10M, and 10K to the development units 4Y, 4C, 4M, and 4K of the image forming units 6Y, 6C, 6M, and 6K via conveying routes (not shown), respectively.

The development units 4Y, 4C, 4M, and 4K develop the electrostatic latent images formed on the surfaces of the photoconductors 1Y, 1C, 1M, and 1K with the yellow, cyan, magenta, and black toners to form yellow, cyan, magenta, and black toner images, respectively.

The intermediate transfer belt 31 rotates in a rotating direction B. A transfer bias is applied to the first transfer rollers 32Y, 32C, 32M, and 32K. The first transfer rollers 32Y, 32C, 32M, and 32K transfer the yellow, cyan, magenta, and black toner images formed on the surfaces of the photoconductors 1Y, 1C, 1M, and 1K onto an outer circumferential surface of the rotating intermediate transfer belt 31, respectively. For example, the yellow, cyan, magenta, and black toner images are transferred and superimposed at different times in this order onto the outer circumferential surface of the intermediate transfer belt 31. Thus, the yellow, cyan, magenta, and black toner images are superimposed on a common position on the outer circumferential surface of the intermediate transfer belt 31.

The lubricant applicators 3Y, 3C, 3M, and 3K apply a lubricant onto the surfaces of the photoconductors 1Y, 1C, 1M, and 1K, respectively. The cleaners 8Y, 8C, 8M, and 8K remove residual toners remaining on the surfaces of the photoconductors 1Y, 1C, 1M, and 1K after the yellow, cyan, magenta, and black toner images formed on the surfaces of the photoconductors 1Y, 1C, 1M, and 1K are transferred onto the outer circumferential surface of the intermediate transfer belt 31, respectively. Screws (not shown) provided in the cleaners 8Y, 8C, 8M, and 8K convey the removed toners out of the image forming units 6Y, 6C, 6M, and 6K, respectively, into a waste toner bottle (not shown) provided in the image forming apparatus 100.

The paper tray 20 loads a recording medium (e.g., sheets P). The feeding roller 21 feeds sheets P one by one toward a transfer nip formed between the second transfer roller 34 and the intermediate transfer belt 31.

The second transfer roller 34 transfers the yellow, cyan, magenta, and black toner images superimposed on the outer circumferential surface of the intermediate transfer belt 31 onto the sheet P at the transfer nip. Thus, a color toner image is formed on the sheet P. The cleaner 33 removes residual toners remaining on the outer circumferential surface of the intermediate transfer belt 31 after the yellow, cyan, magenta, and black toner images superimposed on the outer circumferential surface of the intermediate transfer belt 31 are transferred onto the sheet P at the transfer nip. The second transfer roller 34 and the intermediate transfer belt 31 feed the sheet bearing the color toner image toward the fixing unit 40. The fixing unit 40 applies heat to the sheet P bearing the color toner image to fix the color toner image on the sheet P. The output roller pair 41 feeds the sheet P bearing the fixed color toner image onto the outside of the image forming apparatus 100, for example, to an output tray (not shown).

Figure 2:
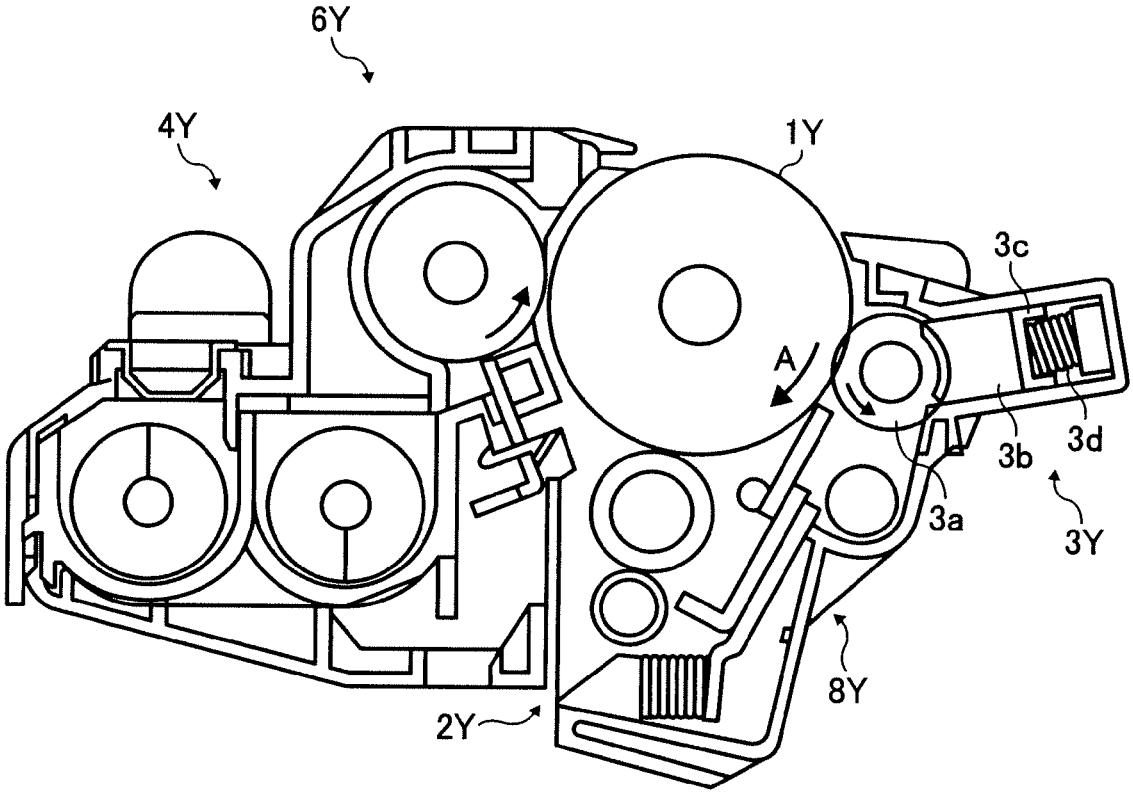
FIG. 2 is a schematic view of a process cartridge included in the image forming apparatus shown in FIG. 1.

FIG. 2 illustrates the structure of the image forming unit 6Y, which is common to the image forming units 6C, 6M, and 6K (depicted in FIG. 1). As illustrated in FIG. 2, the lubricant applicator 3Y of the image forming unit 6Y includes a solid lubricant 3*b*, a brush roller 3*a*, a holder 3*c*, and a pressing member 3*d*.

The solid lubricant 3*b* and the brush roller 3*a* are provided in a case (not shown) fixed in the lubricant applicator 3Y. The brush roller 3*a* contacts and scrapes off the solid lubricant 3*b* so as to apply the scraped solid lubricant 3*b* to the photoconductor 1Y. The solid lubricant 3*b* has a bar-like shape and is attached to the holder 3*c* with double-faced tape, an adhesive, or the like. The pressing member 3*d* applies a pressure for pressing the solid lubricant 3*b* toward the brush roller 3*a*. As the brush roller 3*a* scrapes off the solid lubricant 3*b*, the solid lubricant 3*b* becomes smaller. However, the pressure applied by the pressing member 3*d* causes the solid lubricant 3*b* to constantly contact the brush roller 3*a*. The brush roller 3*a* rotates to apply the scraped solid lubricant 3*b* to the surface of the photoconductor 1Y.

Figure 3:
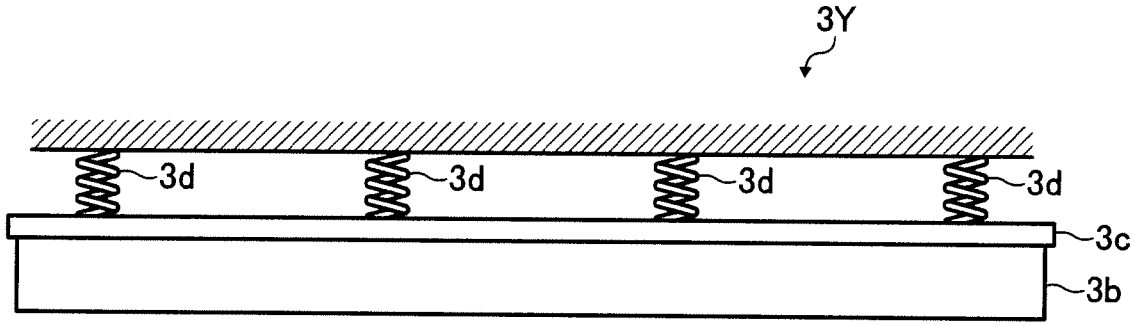
FIG. 3 is a front view of a lubricant applicator included in the process cartridge shown in FIG. 2.

FIG. 3 is a front view of the lubricant applicator 3Y taken along a longitudinal direction of the lubricant applicator 3Y. The solid lubricant 3*b* may include an aliphatic acid metal salt, fluoroplastic, and/or the like. However, the solid lubricant 3*b* may preferably include the aliphatic acid metal salt. Examples of the aliphatic acid include an aliphatic acid including straight-chain hydrocarbons, that is, a myristic acid, a palmitic acid, a stearic acid, and/or an oleic acid. Examples of the metal include lithium, magnesium, calcium, strontium, zinc, cadmium, aluminum, cerium, titanium, magnesium stearate, aluminum stearate, iron stearate, and/or zinc stearate. Among the above, zinc stearate is preferable.

The solid lubricant 3*b* includes the above-described aliphatic acid metal salt formed in a rectangular parallelepiped shape. The solid lubricant 3*b* is fixed to the holder 3*c*. A plurality of pressing members 3*d* are arranged on the holder 3*c* in the longitudinal direction of the lubricant applicator 3Y to press the solid lubricant 3*b* toward the brush roller 3*a* (depicted in FIG. 2) via the holder 3*c*.

The pressing member 3*d* may include a plate spring and/or a compression spring. However, the pressing member 3*d* may preferably include the compression spring as illustrated in FIG. 3. As the brush roller 3*a* (depicted in FIG. 2) scrapes off the solid lubricant 3*b*, the solid lubricant 3*b* becomes smaller. A pressure applied to the solid lubricant 3*b* by the pressing member 3*d* also becomes smaller. To address this problem, the pressing member 3*d* may preferably have a small spring constant, so that the pressure applied to the solid lubricant 3*b* does not substantially vary. The pressing member 3*d* can easily have a small spring constant when the pressing member 3*d* includes a compression spring having an increased diameter. However, when the image forming unit 6Y (depicted in FIG. 2) is compact in size, the compression spring having the increased diameter may not be placed in the image forming unit 6Y.

When the compression spring has an ellipse shape, for example, the compact size image forming unit 6Y can include the pressing member 3*d* having a small spring constant. Namely, when an ellipse has a circumferential length common to a circle, the ellipse can be assumed as the circle. For example, a circular spring having the diameter of 5 mm has a circumferential length substantially common to an ellipse spring having the diameters of 4 mm and 6 mm. Therefore, when a case for containing a spring has a dimension of 5 mm, the circular spring having the diameter of 5 mm cannot be placed in the case, when the spring has the wire diameter of 0.3 mm, for example. However, the case can contain the ellipse spring having the diameters of 4 mm and 6 mm. Thus, the spring having a small spring constant can be placed in a saved space.

Figure 4A:
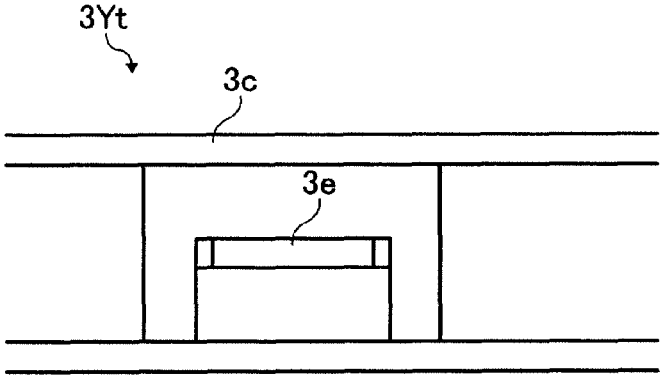
FIG. 4A is a top view of a tester lubricant applicator.
Figure 4B:
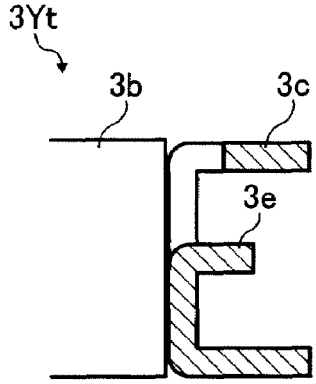
FIG. 4B is a sectional side view of the tester lubricant applicator shown in FIG. 4A.
Figure 4C:
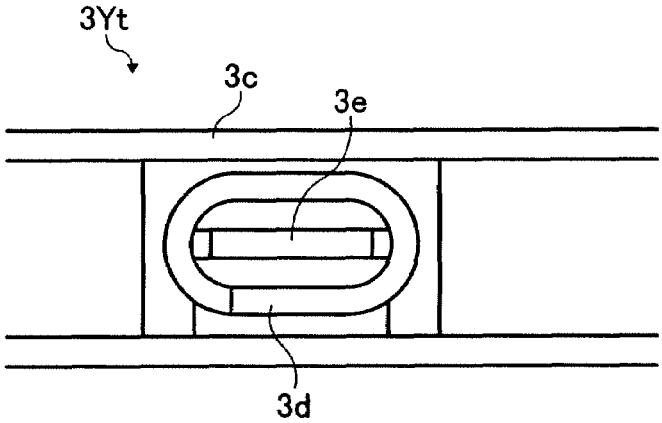
FIG. 4C is a top view of the tester lubricant applicator shown in FIG. 4A after a pressing member is set.
Figure 4D:
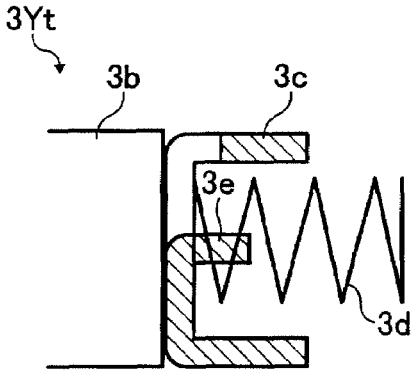
FIG. 4D is a sectional side view of the tester lubricant applicator shown in FIG. 4C.

FIGS. 4A, 4B, 4C, and 4D illustrate a tester lubricant applicator 3Yt including a protrusion 3*e* for supporting the pressing member 3*d*. The tester lubricant applicator 3Yt has the structure common to the lubricant applicator 3Y (depicted in FIGS. 2 and 3). FIG. 4A is a top view of the tester lubricant applicator 3Yt before the pressing member 3*d* is set. FIG. 4B is a sectional side view of the tester lubricant applicator 3Yt before the pressing member 3*d* is set. FIG. 4C is a top view of the tester lubricant applicator 3Yt after the pressing member 3*d* is set. FIG. 4D is a sectional side view of the tester lubricant applicator 3Yt after the pressing member 3*d* is set.

As illustrated in FIG. 4A, the protrusion 3*e* has a plate shape and is provided on the holder 3*c*. As illustrated in FIG. 4B, the protrusion 3*e* protrudes from the holder 3*c*. As illustrated in FIG. 4C, the pressing member 3*d* has an ellipse shape. To set the pressing member 3*d* onto the holder 3*c*, the pressing member 3*d* engages with the protrusion 3*e* in a manner that the protrusion 3*e* contacts an inner circumferential surface of the pressing member 3*d* at both end portions in a direction of a major axis of an ellipse formed by the pressing member 3*d*. Thus, the holder 3*c* holds the pressing member 3*d* at a fixed position on the holder 3*c*.

Figure 5A:
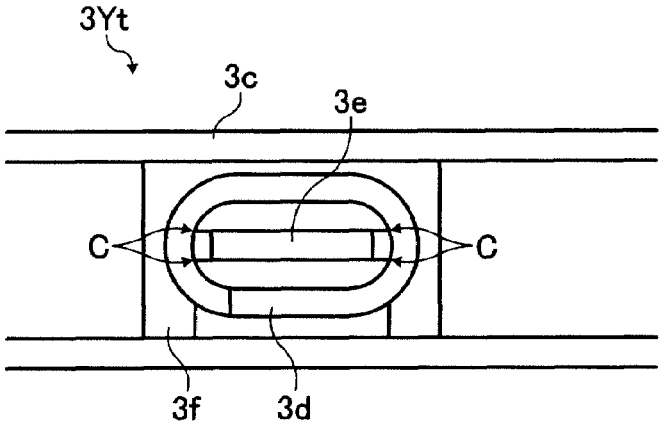
FIG. 5A is a top view of the tester lubricant applicator shown in FIG. 4A after a pressing member having a small inner diameter is set.
Figure 5B:
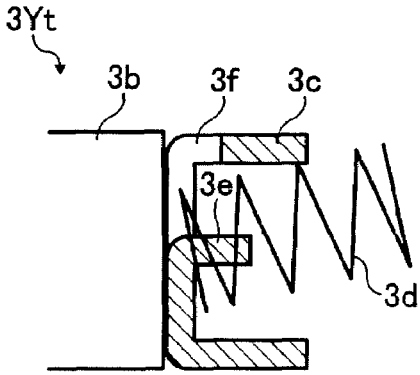
FIG. 5B is a sectional side view of the tester lubricant applicator shown in FIG. 5A.

FIGS. 5A and 5B illustrate the tester lubricant applicator 3Yt after the pressing member 3*d* having a small inner diameter is set. As illustrated in FIGS. 5A and 5B, the holder 3*c* of the tester lubricant applicator 3Yt includes a hole 3*f*. The hole 3*f* is created on the holder 3*c* (e.g., a metal sheet) when the protrusion 3*e* is formed by cutting a part of the holder 3*c* and lifting the cut part. As illustrated in FIG. 5A, the protrusion 3*e* contacts the inner circumferential surface of the pressing member 3*d* at four positions C. When the pressing member 3*d* has a small inner diameter due to size variations in manufacturing processes, for example, the pressing member 3*d* may bite the protrusion 3*e* at the four positions C. Namely, the pressing member 3*d* cannot be easily set on the holder 3*c*.

As illustrated in FIG. 5B, when the pressing member 3*d* is set on the holder 3*c*, the pressing member 3*d* is partially supported by the holder 3*c* at the bottom of the pressing member 3*d* due to the hole 3*f* formed on the holder 3*c*. As a result, the pressing member 3*d* may slant and thereby may not apply a proper pressure to the holder 3*c*.

Figure 6A:
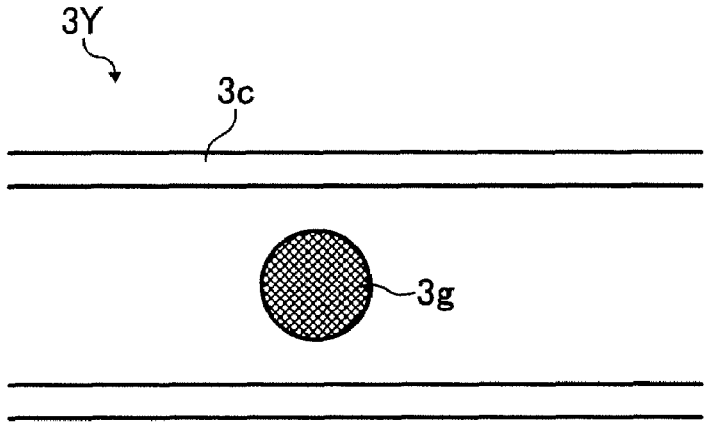
FIG. 6A is a top view of the lubricant applicator shown in FIG. 3.
Figure 6B:
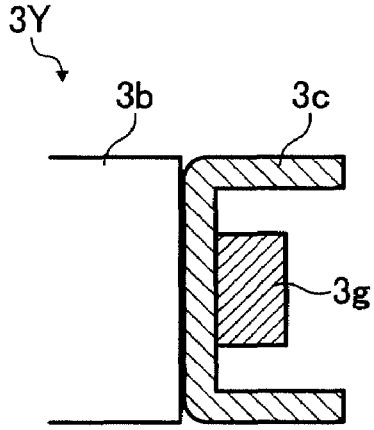
FIG. 6B is a sectional side view of the lubricant applicator shown in FIG. 6A.
Figure 6C:
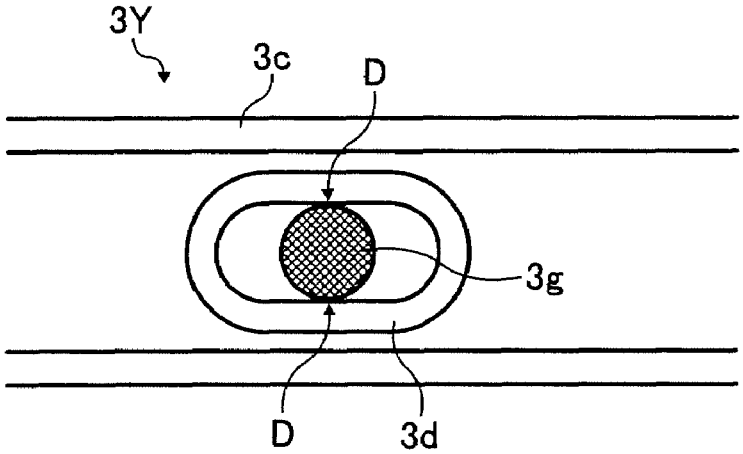
FIG. 6C is a top view of the lubricant applicator shown in FIG. 6A after a pressing member is set.

FIGS. 6A, 6B, 6C, and 6D illustrate the lubricant applicator 3Y including a protrusion 3*g* for supporting the pressing member 3*d*. As illustrated in FIGS. 6A and 6B, the protrusion 3*g* has a cylindrical shape. As illustrated in FIG. 6C, the protrusion 3*g* contacts the inner circumferential surface of the pressing member 3*d* at two positions D provided in both end portions of the pressing member 3*d* in a direction of a minor axis of an ellipse formed by the pressing member 3*d*. Namely, the protrusion 3*g* contacts the pressing member 3*d* at fewer positions than the protrusion 3*e* (depicted in FIG. 5A) of the tester lubricant applicator 3Yt. As a result, the pressing member 3*d* can be easily set on the holder 3*c*.

Figure 6D:
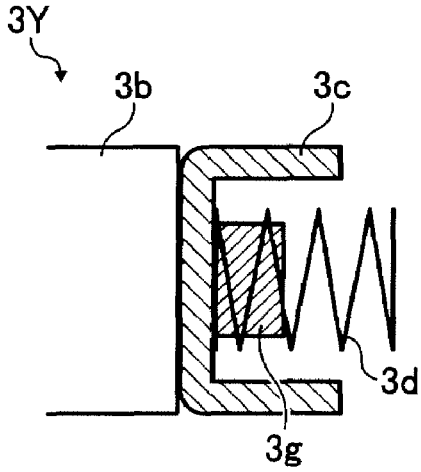
FIG. 6D is a sectional side view of the lubricant applicator shown in FIG. 6C.

As illustrated in FIG. 6D, the holder 3*c* wholly supports the pressing member 3*d* at the bottom of the pressing member 3*d*. As a result, when the pressing member 3*d* is set on the holder 3*c*, the pressing member 3*d* may not slant.

Figure 7A:
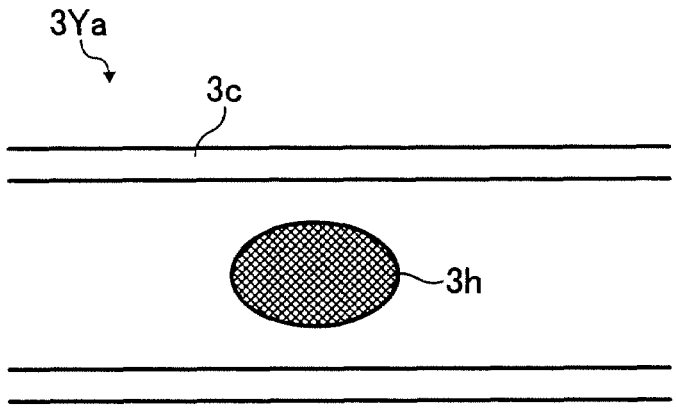
FIG. 7A is a top view of a lubricant applicator according to another exemplary embodiment of the present invention.
Figure 7B:
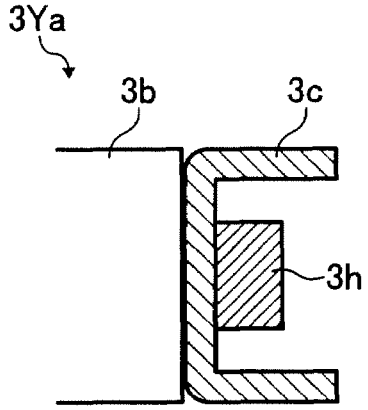
FIG. 7B is a sectional side view of the lubricant applicator shown in FIG. 7A.
Figure 7C:
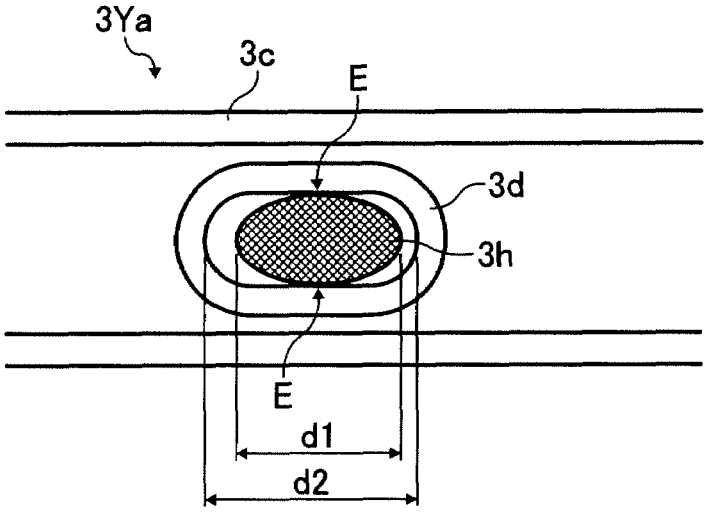
FIG. 7C is a top view of the lubricant applicator shown in FIG. 7A after a pressing member is set.

FIGS. 7A, 7B, 7C, and 7D illustrate a lubricant applicator 3Ya including a protrusion 3*h* for supporting the pressing member 3*d*. The elements of the lubricant applicator 3Ya other than the protrusion 3*h* are common to the lubricant applicator 3Y (depicted in FIGS. 6A, 6B, 6C, and 6D). As illustrated in FIGS. 7A and 7B, the protrusion 3*h* has a cylindroid shape. As illustrated in FIG. 7C, the protrusion 3*h* contacts the inner circumferential surface of the pressing member 3*d* at two positions E provided in both end portions of the pressing member 3*d* in a direction of a minor axis of an ellipse formed by the pressing member 3*d*.

As illustrated in FIG. 7C, a diameter d1 of the protrusion 3*h* in a direction of a major axis of a cross section ellipse formed by the protrusion 3*h* is smaller than an inner diameter d2 of the pressing member 3*d* in a direction of a major axis of an ellipse formed by the pressing member 3*d*. Thus, the pressing member 3*d* may not substantially move in the direction of the major axis of the ellipse formed by the pressing member 3*d*. As a result, when the pressing member 3*d* is set on the holder 3*c*, the position of the pressing member 3*d* may not vary in the direction of the major axis of the ellipse formed by the pressing member 3*d*.

Figure 7D:
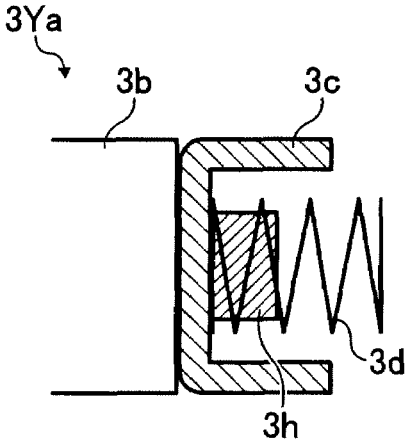
FIG. 7D is a sectional side view of the lubricant applicator shown in FIG. 7C.

When the holder 3*c* includes a metal sheet, the holder 3*c* can be embossed to form the protrusion 3*g* (depicted in FIG. 6D) or 3*h* (depicted in FIG. 7D). When the holder 3*c* includes a resin, the protrusion 3*g* or 3*h* can be integrally molded with the holder 3*c*. The holder 3*c* does not include the hole 3*f* (depicted in FIG. 5B). Thus, the holder 3*c* wholly supports the pressing member 3*d* at the bottom of the pressing member 3*d*, as illustrated in FIGS. 6D and 7D. As a result, when the pressing member 3*d* is set on the holder 3*c*, the pressing member 3*d* may not slant.

Figure 8A:
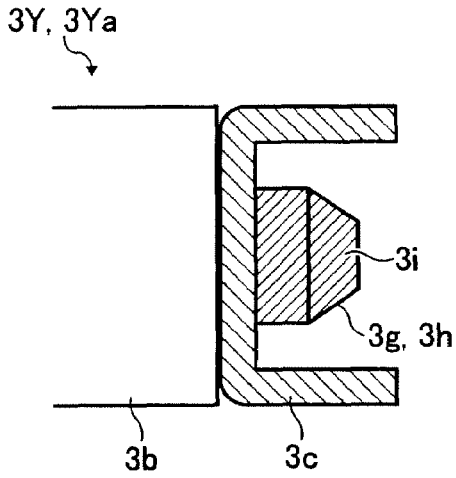
FIG. 8A is a sectional side view of a protrusion included in the lubricant applicator shown in FIG. 6A or 7A and having an exemplary shape.
Figure 8B:
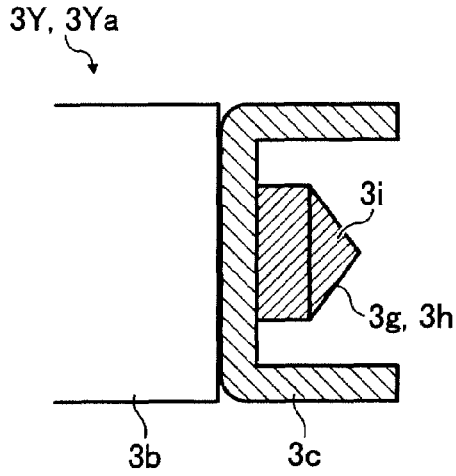
FIG. 8B is a sectional side view of a protrusion included in the lubricant applicator shown in FIG. 6A or 7A and having another exemplary shape.
Figure 8C:
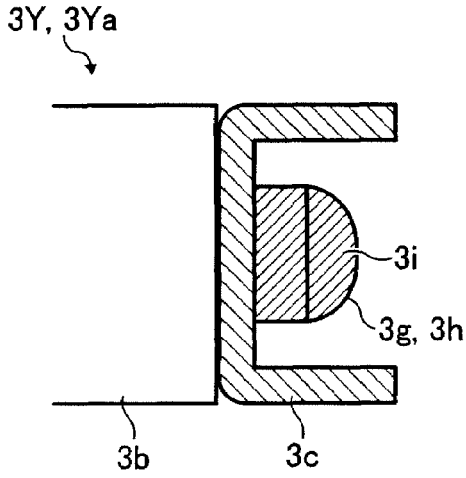
FIG. 8C is a sectional side view of a protrusion included in the lubricant applicator shown in FIG. 6A or 7A and having yet another exemplary shape.

FIGS. 8A, 8B, and 8C illustrate the protrusion 3*g* or 3*h* having example head shapes. Each of the protrusions 3*g* and 3*h* includes a head portion 31. As illustrated in FIG. 8A, the head portion 31 may be tapered. As illustrated in FIG. 8B, the head portion 31 may have a conical shape. As illustrated in FIG. 8C, the head portion 31 may have a hemispherical shape. When the protrusions 3*g* and 3*h* are shaped as illustrated in FIG. 8A, 8B, or 8C, the pressing member 3*d* can easily engage with the protrusion 3*g* or 3*h*.

As illustrated in FIGS. 6C and 7C, according to the non-limiting exemplary embodiments, the protrusion 3*g* or 3*h* is provided on the holder 3*c* for supporting the solid lubricant 3*b* (depicted in FIGS. 6D and 7D). The protrusion 3*g* has a cylindrical shape. The protrusion 3*h* has a cylindroid shape. The protrusion 3*g* or 3*h* contacts the inner circumferential surface of the pressing member 3*d* at the two positions D or E provided in both end portions of the pressing member 3*d* in the direction of the minor axis of an ellipse formed by the pressing member 3*d*, respectively. Thus, the pressing member 3*d* can be attached to the protrusion 3*g* or 3*h* more easily than the protrusion 3*e* (depicted in FIG. 5A) having a plate shape to which the pressing member 3*d* is attached at the four positions C (depicted in FIG. 5A) provided in both end portions of the pressing member 3*d* in the direction of the major axis of an ellipse formed by the pressing member 3*d*.

As illustrated in FIG. 2, according to the non-limiting exemplary embodiments, the lubricant applicator 3Y including the holder 3*c* is provided in the image forming unit 6Y serving as a process cartridge. As illustrated in FIG. 1, the image forming unit 6Y can be installed in the image forming apparatus 100. Thus, the image forming unit 6Y and the image forming apparatus 100 can provide a high quality image and an improved cleaning property.

Toner particles used in the development units 4Y, 4C, 4M, and 4K (depicted in FIG. 1) preferably have an increased circular degree (e.g., an average circular degree not smaller than about 0.93). When the cleaners 8Y, 8C, 8M, and 8K (depicted in FIG. 1) include cleaning blades (not shown) for cleaning the surfaces of the photoconductors 1Y, 1C, 1M, and 1K (depicted in FIG. 1), respectively, the toner particles having the increased circular degree easily enter gaps formed between the photoconductors 1Y, 1C, 1M, and 1K and the cleaning blades and slip on the surfaces of the photoconductors 1Y, 1C, 1M, and 1K, respectively. However, the toner particles having the increased circular degree are easily transferred, resulting in a reduced amount of residual toner particles remaining on the surfaces of the photoconductors 1Y, 1C, 1M, and 1K. The toner particles preferably have a substantially spherical shape. The substantially spherical shape is defined by shape factors SF-1 and SF-2 described below. Toner particles used in the image forming apparatus 100 have the shape factor SF-1 in a range of from about 100 to about 180 and the shape factor SF-2 in a range of from about 100 to about 180.

Figure 9A:
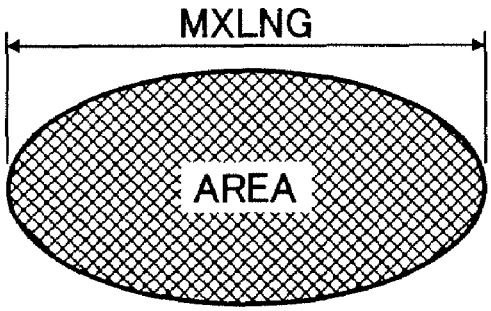
FIG. 9A is an illustration of a toner particle for explaining a shape factor SF-1.

FIG. 9A illustrates a typical shape of a toner particle having the shape factor SF-1. The shape factor SF-1 indicates a degree of roundness of a toner particle and is represented by an equation 1 below. The shape factor SF-1 (i.e., F in the equation 1) of the toner particle is calculated by squaring a maximum length MXLNG (i.e., G in the equation 1) of the toner particle projected on a two-dimensional plane, dividing the squared value by an area AREA (i.e., H in the equation 1) of the projected toner particle, and multiplying the divided value by $100\times\pi/4$. When the shape factor SF-1 is 100, the toner particle has a spherical shape. The greater the shape factor SF-1 of the toner particle is, the more the toner particle has an amorphous shape.

$$F=(G^2/H)\times(100\times\pi/4) \quad \text{Equation 1}$$

Figure 9B:
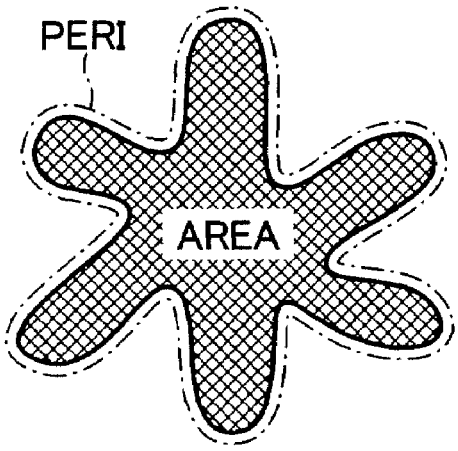
FIG. 9B is an illustration of a toner particle for explaining a shape factor SF-2.

FIG. 9B illustrates a typical shape of a toner particle having the shape factor SF-2. The shape factor SF-2 indicates a degree of concavo-convexity of the toner particle and is represented by an equation 2 below. The shape factor SF-2 (i.e., I in the equation 2) of the toner particle is calculated by squaring a peripheral length PER1 (i.e., J in the equation 2) of the toner particle projected on a two-dimensional plane, dividing the squared value by an area AREA (i.e., K in the equation 2) of the projected toner particle, and multiplying the divided value by $100\times1/4\pi$. When the shape factor SF-2 is 100, a surface of the toner particle has no concavity and convexity. The greater the shape factor SF-2 of the toner particle is, the more the toner particle has a roughened surface.

$$I=(J^2/K)\times(100\times1/4\pi) \quad \text{Equation 2}$$

The shape factors SF-1 and SF-2 of toner particles were determined by photographing the toner particles with a scanning electron microscope S-800 available from Hitachi, Ltd.

and analyzing the photographed images with an image analyzer LUZEX III available from NIRECO Corporation.

When toner particles have a sphere-like shape, the toner particles come into point-contact with each other. The toner particles also come into point-contact with the surfaces of the photoconductors 1Y, 1C, 1M, and 1K (depicted in FIG. 1). The attracting force between the toner particles becomes weaker. As a result, the fluidity of the toner particles becomes greater. The attracting force between the toner particles and the photoconductors 1Y, 1C, 1M, and 1K also becomes weaker. As a result, the toner particles can be transferred from the photoconductors 1Y, 1C, 1M, and 1K onto the intermediate transfer belt 31 (depicted in FIG. 1) at an increased transfer rate. When the brush roller 3*a* (depicted in FIG. 2) applies a bias to the toner particles, the toner particles can be easily collected and discharged by the brush roller 3*a*. When the shape factors SF-1 and SF-2 of the toner particles increase, positively and negatively charged toner particles are not easily collected and discharged. As a result, a ghost image having a previously transferred toner image and a faulty image having background soiling may be formed on a sheet P. To prevent those faulty images, the shape factors SF-1 and SF-2 of the toner particles are preferably not greater than about 180.

When the toner particles have a small particle size (e.g., a volume average particle size in a range of from about 3 μm to about 8 μm) and a narrow particle size distribution (e.g., a ratio Dv/Dn of a volume average particle size Dv to a number average particle size Dn in a range of from about 1.00 to about 1.40), a charging quantity distribution of the toner particles becomes uniform. As a result, a high quality image with reduced background soiling can be formed on a sheet P. The toner particles can be transferred from the photoconductors 1Y, 1C, 1M, and 1K onto the intermediate transfer belt 31 at an increased transfer rate. Thus, a reduced amount of toner particles is collected into a temporary container (not shown). As a result, the image forming apparatus 100 can provide stable operations and a long life. The small size toner particles tend to contain a relatively increased amount of fine particles of an additive and/or the like. The fine particles of the additive easily separate from the toner particles and form a film on the surfaces of the photoconductors 1Y, 1C, 1M, and 1K. However, the brush roller 3*a* slides on the surfaces of the photoconductors 1Y, 1C, 1M, and 1K so as to mechanically remove the film or prevent the film from being formed.

A toner preferably used in the image forming apparatus 100 is produced by dispersing at least a polyester prepolymer having a functional group including a nitrogen atom, polyester, a colorant, and a releasing agent in an organic solvent to produce a toner material liquid, and cross-linking and/or elongating the toner material liquid in an aqueous solvent. The following describes materials used for producing the toner and how to produce the toner.

A toner used in the image forming apparatus 100 according to an exemplary embodiment includes a modified polyester (i) as a binder resin. The modified polyester (i) denotes a polyester resin having a bonding group other than an ester bond or a polyester resin in which resin components having different structures from each other are bound by covalent or ionic binding. Specifically, the modified polyester (i) is obtained by introducing a functional group (e.g., a carboxylic acid group, an isocyanate group reacting with a hydroxyl group, and/or the like) at an end of a polyester and reacting the polyester with a compound including active hydrogen to modify the end of the polyester. Examples of the modified polyester (i) include a urea-modified polyester obtained by reacting a polyester prepolymer (A) having an isocyanate group with an amine (B). The polyester prepolymer (A) having the isocyanate group is obtained by reacting a polyester, which is produced by polycondensation of a polyhydric alcohol (PO) and a poly carboxylic acid (PC) and has an active hydrogen group, with a polyisocyanate compound (PIC). Examples of the active hydrogen group include hydroxyl groups (e.g., an alcoholic hydroxyl group, a phenolic hydroxyl group, and/or the like), an amino group, a carboxyl group, and/or a mercapto group. Among the above, the alcoholic hydroxyl group is preferable.

The following describes how to produce the urea-modified polyester. Examples of the polyhydric alcohol (PO) include a dihydric alcohol (DIO) and/or a poly (trivalent or more) hydric alcohol (TO). Among the above, the dihydric alcohol (DIO) alone or a mixture of the dihydric alcohol (DIO) and a small amount of the poly hydric alcohol (TO) is preferable. Examples of the dihydric alcohol (DIO) include alkylene glycols (e.g., ethylene glycol, 1,2-propylene glycol, 1,3-propylene glycol, 1,4-butanediol, 1,6-hexanediol, and/or the like), alkylene ether glycols (e.g., diethylene glycol, triethylene glycol, dipropylene glycol, polyethylene glycol, polypropylene glycol, polytetramethylene ether glycol, and/or the like), alicyclic diols (e.g., 1,4-cyclohexane dimethanol, hydrogenated bisphenol A, and/or the like), bisphenols (e.g., bisphenol A, bisphenol F, bisphenol S, and/or the like), alkylene oxide (e.g., ethylene oxide, propylene oxide, butylene oxide, and/or the like) adducts of the alicyclic diol, and/or alkylene oxide (e.g., ethylene oxide, propylene oxide, butylene oxide, and/or the like) adducts of the bisphenol. Among the above, the alkylene glycols having the carbon number of from 2 to 12 and the alkylene oxide adducts of the bisphenol are preferable. A combination of the alkylene oxide adduct of the bisphenol and the alkylene glycol having the carbon number of from 2 to 12 is more preferable. Examples of the poly (trivalent or more) hydric alcohol (TO) include poly (trivalent or more) aliphatic alcohols (e.g., glycerin, trimethylol ethane, trimethylol propane, penta erythritol, sorbitol, and/or the like), poly (trivalent or more) phenols (e.g., tris phenol PA, phenol novolac, cresol novolac, and/or the like), and/or an alkylene oxide adduct of the poly (trivalent or more) phenol.

Examples of the poly carboxylic acid (PC) include a divalent carboxylic acid (DIC) and/or a poly (trivalent or more) carboxylic acid (TC). Among the above, the divalent carboxylic acid (DIC) alone and a mixture of the divalent carboxylic acid (DIC) and a small amount of the poly (trivalent or more) carboxylic acid (TC) are preferable. Examples of the divalent carboxylic acid (DIC) include alkylene dicarboxylic acids (e.g., succinic acid, adipic acid, sebacic acid, and/or the like), alkenylene dicarboxylic acids (e.g., maleic acid, fumaric acid, and/or the like), and/or aromatic dicarboxylic acids (e.g., phthalic acid, isophthalic acid, terephthalic acid, naphthalene dicarboxylic acid, and/or the like). Among the above, the alkenylene dicarboxylic acids having the carbon number of from 4 to 20 and the aromatic dicarboxylic acids having the carbon number of from 8 to 20 are preferable. Examples of the poly (trivalent or more) carboxylic acid (TC) include aromatic polycarboxylic acids having the carbon number of from 9 to 20 (e.g., trimellitic acid, pyromellitic acid, and/or the like). Examples of the polycarboxylic acid (PC) further include an acid anhydride of the above and lower alkyl esters (e.g., methyl ester, ethyl ester, isopropyl ester, and/or the like), which are reacted with the polyhydric alcohol (PO). A ratio of the polyhydric alcohol (PO) to the polycarboxylic acid (PC) is represented by an equivalent ratio [OH]/[COOH] of the hydroxyl group [OH] to the carboxyl group [COOH], which usually ranges from about 2/1 to about 1/1, preferably ranges from about 1.5/1 to about 1/1, and more preferably ranges from about 1.3/1 to about 1.02/1.

Examples of the polyisocyanate compound (PIC) include aliphatic polyisocyanates (e.g., tetramethylene diisocyanate, hexamethylene diisocyanate, 2,6-diisocyanate methylcaproate, and/or the like), alicyclic polyisocyanates (e.g., isophorone diisocyanate, cyclohexylmethane diisocyanate, and/or the like), aromatic diisocyanates (e.g., tolylene diisocyanate, diphenylmethane diisocyanate, and/or the like), aromatic, aliphatic diisocyanates (e.g., α,α,α',α'-tetramethyl xylylene diisocyanate and/or the like), an isocyanate, the above polyisocyanates blocked by a phenolic derivative, oxime, caprolactam, and/or the like, and/or a combination of two or more substances described above.

A ratio of the polyisocyanate compound (PIC) to the polyester resin is represented by an equivalent ratio [NCO]/[OH] of the isocyanate group [NCO] to the hydroxyl group [OH] of the polyester having the hydroxyl group, which usually ranges from about 5/1 to about 1/1, preferably ranges from about 4/1 to about 1.2/1, and more preferably ranges from about 2.5/1 to about 1.5/1. When the ratio [NCO]/[OH] of the isocyanate group [NCO] to the hydroxyl group [OH] is greater than about 5, fixability of the toner at a low temperature may deteriorate. When a molar ratio of the isocyanate group [NCO] is smaller than about 1 and the urea-modified polyester is used, an amount of urea contained in the urea-modified polyester may decrease, resulting in deterioration of hot offset resistance of the toner.

An amount of the polyisocyanate compound (PIC) contained in the polyester prepolymer (A) having the isocyanate group usually occupies from about 0.5 weight percent to about 40 weight percent, preferably from about 1 weight percent to about 30 weight percent, and more preferably from about 2 weight percent to about 20 weight percent. When the amount of the polyisocyanate compound (PIC) occupies smaller than about 0.5 weight percent, hot offset resistance of the toner may deteriorate and the toner may not provide compatibility between heat resistance and fixability at a low temperature. When the amount of the polyisocyanate compound (PIC) occupies more than about 40 weight percent, fixability at a low temperature may deteriorate. The number of the isocyanate groups contained in one molecule of the polyester prepolymer (A) having the isocyanate group is usually not smaller than about 1, preferably ranges from about 1.5 to about 3 on average, and more preferably ranges from about 1.8 to about 2.5 on average. When the number of the isocyanate groups is smaller than about 1, a molecular weight of the urea-modified polyester may decrease, resulting in deterioration of hot offset resistance of the toner.

Examples of the amine (B) reacting with the polyester prepolymer (A) include a divalent amine compound (B1), a poly (trivalent or more) amine compound (B2), an amino alcohol (B3), an amino mercaptan (B4), an amino acid (B5), and/or a compound (B6) obtained by blocking the amino group of the divalent amine compound (B1), the poly (trivalent or more) amine compound (B2), the amino alcohol (B3), the amino mercaptan (B4), or the amino acid (B5). Examples of the divalent amine compound (B1) include aromatic diamines (e.g., phenylene diamine, diethyl toluene diamine, 4,4'-diamino diphenyl methane, and/or the like), alicyclic diamines (e.g., 4,4'-diamino-3,3'-dimethyl dicyclohexyl methane, diamine cyclohexane, isophorone diamine, and/or the like), and/or aliphatic diamines (e.g., ethylene diamine, tetramethylene diamine, hexamethylene diamine, and/or the like). Examples of the poly (trivalent or more) amine compound (B2) include a diethylene triamine and/or a triethylene tetramine. Examples of the amino alcohol include an ethanolamine and/or a hydroxyethyl aniline. Examples of the amino mercaptan (B4) include an aminoethyl mercaptan and/or an aminopropyl mercaptan. Examples of the amino acid (B5) include an aminopropionic acid and/or an aminocaproic acid. Examples of the compound (B6) include a ketimine compound and/or an oxazolidine compound obtained by reacting the divalent amine compound (B1), the poly (trivalent or more) amine compound (B2), the amino alcohol (B3), the amino mercaptan (B4), or the amino acid (B5) with a ketone (e.g., acetone, methyl ethyl ketone, methyl isobutyl ketone, and/or the like). Among the above amines (B), the divalent amine compound (B1) and a mixture of the divalent amine compound (B1) and a small amount of the poly (trivalent or more) amine compound (B2) are preferable.

A ratio of the polyester prepolymer (A) having the isocyanate group to the amine (B) is represented by an equivalent ratio [NCO]/[$NH_X$] of the isocyanate group [NCO] of the polyester prepolymer (A) to the amino group [NHx] of the amine (B), which usually ranges from about 1/2 to about 2/1, preferably ranges from about 1.5/1 to about 1/1.5, and more preferably ranges from about 1.2/1 to about 1/1.2. When the ratio [NCO]/[NHx] is greater than about 2/1 or smaller than about 1/2, the molecular weight of the urea-modified polyester may decrease, resulting in deterioration of hot offset resistance of the toner.

The urea-modified polyester may contain a urea bond as well as a urethane bond. A molar ratio of the urea bond to the urethane bond usually ranges from about 100/0 to about 10/90, preferably ranges from about 80/20 to about 20/80, and more preferably ranges from about 60/40 to about 30/70. When the molar ratio is smaller than about 10 percent, hot offset resistance of the toner may deteriorate.

The modified polyester (i) is produced by a one-shot method or a prepolymer method, for example. A weight average molecular weight of the modified polyester (i) is usually not smaller than about 10,000, preferably ranges from about 20,000 to about 10,000,000, and more preferably ranges from about 30,000 to about 1,000,000. A peak molecular weight of the modified polyester (i) preferably ranges from about 1,000 to about 10,000. When the molecular weight is smaller than about 1,000, the toner may not be easily elongated and may have a decreased elasticity. As a result, hot offset resistance of the toner may deteriorate. When the molecular weight is greater than about 10,000, fixability of the toner may deteriorate and challenges may generate in manufacturing processes such as granulating and pulverizing processes.

When an unmodified polyester (ii) described below is used, the number average molecular weight of the modified polyester (i) is not limited, but may preferably satisfy the weight average molecular weight. The number average molecular weight of the modified polyester (i) alone is usually not greater than about 20,000, preferably ranges from about 1,000 to about 10,000, and more preferably ranges from about 2,000 to about 8,000. When the number average molecular weight of the modified polyester (i) is greater than about 20,000, fixability of the toner at a low temperature may deteriorate. The gloss of a color toner image formed on a sheet P may also deteriorate when the toner is used in the image forming apparatus 100 for forming a color toner image.

When the polyester prepolymer (A) and the amine (B) are cross-linked and/or elongated to produce the modified polyester (i), a reaction stopping agent may be added as needed to adjust the molecular weight of the urea-modified polyester. The reaction stopping agent includes monoamines (e.g., diethyl amine, dibutyl amine, butyl amine, lauryl amine, and/or the like) and compounds obtained by blocking the above monoamines (e.g., a ketimine compound and/or the like).

A toner used in the image forming apparatus 100 according to this non-limiting exemplary embodiment may include the modified polyester (i) alone as a binder resin. However, the toner may further include an unmodified polyester (ii) as a binder resin in addition to the modified polyester (i). When the unmodified polyester (ii) is added, fixability of the toner at a low temperature may be improved. The gloss of a color toner image formed on a sheet P may also be improved when the toner is used in the image forming apparatus 100 for forming a color toner image. Therefore, the toner may preferably include both the modified polyester (i) and the unmodified polyester (ii). Examples of the unmodified polyester (ii) include a compound obtained by polycondensation of the polyhydric alcohol (PO) including a component similar to a polyester component of the modified polyester (i) with the poly carboxylic acid (PC). The unmodified polyester (ii) preferably includes components that the modified polyester (i) preferably includes. The unmodified polyester (ii) may be obtained by modification with a chemical bond other than the urea bond, for example, the urethane bond. When at least a part of the modified polyester (i) and the unmodified polyester (ii) are compatible with each other, the modified polyester (i) and the unmodified polyester (ii) may provide an improved fixability at a low temperature and an improved hot offset resistance. Therefore, the polyester component of the modified polyester (i) and the unmodified polyester (ii) preferably include a similar composition. A weight ratio of the modified polyester (i) to the unmodified polyester (ii) usually ranges from about 5/95 to about 80/20, preferably ranges from about 5/95 to about 30/70, more preferably ranges from about 5/95 to about 25/75, and even more preferably ranges from about 7/93 to about 20/80. When the modified polyester resin (i) occupies smaller than about 5 percent, hot offset resistance of the toner may deteriorate and the toner may not provide compatibility between heat resistance and fixability at a low temperature.

A peak molecular weight of the unmodified polyester (ii) usually ranges from about 1,000 to about 10,000, preferably ranges from about 2,000 to about 8,000, and more preferably ranges from about 2,000 to about 5,000. When the peak molecular weight of the unmodified polyester (ii) is smaller than about 1,000, heat resistance of the toner may deteriorate. When the peak molecular weight of the unmodified polyester (ii) is greater than about 10,000, fixability at a low temperature may deteriorate. The number of the hydroxyl groups of the unmodified polyester (ii) is preferably greater than about 5, more preferably ranges from about 10 to about 120, and even more preferably ranges from about 20 to about 80. When the number of the hydroxyl groups of the unmodified polyester (ii) is smaller than about 5, the toner may not provide compatibility between heat resistance and fixability at a low temperature. The acid number of the unmodified polyester (ii) preferably ranges from about 1 to about 5, and more preferably ranges from about 2 to about 4. The toner includes a wax having a high acid number. Therefore, when the toner, which is contained in a two-component developer, includes a binder having a low acid number, the toner may provide an improved charging property and an improved volume resistivity.

A glass transition point (Tg) of the binder resin usually ranges from about 35 degrees centigrade to about 70 degrees centigrade and preferably ranges from about 55 degrees centigrade to about 65 degrees centigrade. When the glass transition point (Tg) is lower than about 35 degrees centigrade, heat resistance of the toner may deteriorate. When the glass transition point (Tg) is higher than about 70 degrees centigrade, the toner may provide an insufficient fixability at a low temperature. The surface of a toner particle may be easily formed with the urea-modified polyester. Therefore, the toner according to this non-limiting exemplary embodiment, even when having a low transition point (Tg), may provide an improved heat resistance compared to a known polyester toner.

Various known dyes and pigments can be used as a colorant according to this non-limiting exemplary embodiment. Examples of the dyes and pigments include carbon black, nigrosine, black ironoxide, Naphthol Yellow S, Hanza Yellow (10G, 5G, and G), Cadmium Yellow, yellow iron oxide, loess, chrome yellow, Titan Yellow, polyazo yellow, Oil Yellow, Hanza Yellow (GR, A, RN, and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, colcothar, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone, and/or a mixture of the above. The colorant content in the toner usually ranges from about 1 weight percent to about 15 weight percent and preferably ranges from about 3 weight percent to about 10 weight percent.

The colorant can be used as a master batch complexed with a resin. Examples of a binder resin mixed and kneaded with the colorant for producing a master batch include a polymer of styrenes (e.g., polystyrene, poly-p-chlorostyrene, polyvinyltoluene, and/or the like) and a substitution of the above, a copolymer of the above and a vinyl compound, polymethyl methacrylate, polybutyl methacrylate, polyvinyl chloride, polyvinyl acetate, polyethylene, polypropylene, polyester, an epoxy resin, an epoxy polyol resin, polyurethane, polyamide, polyvinyl butyral, a polyacrylic resin, rosin, modified rosin, a terpene resin, an aliphatic or alicyclic hydrocarbon resin, an aromatic petroleum resin, chlorinated paraffin, and/or paraffin wax. Any one of the above substances or a mixture of the above substances can be used.

Various known charging control agents can be used as a charging control agent according to this non-limiting exemplary embodiment. Examples of the charging control agent include a nigrosine dye, a triphenylmethane dye, a metal complex dye including chrome, a chelate molybdate pigment, a rhodamine dye, an alkoxy amine, a quarternary ammonium salt (including a fluorine-modified quarternary ammonium salt), an alkylamide, a phosphor and a phosphoric compound, a tungsten and a tungstic compound, a fluorochemical surfactant, a salicylic acid metallic salt, and/or a metallic salt of a salicylic acid derivative. Example products of the charging control agent include BONTRON 03 as a nigrosine dye, BONTRON P-51 as a quarternary ammonium salt, BONTRON S-34 as an azo dye including metal, BONTRON E-82 as an oxynaphthoic acid metal complex, BONTRON E-84 as a salicyclic acid metal complex, and BONTRON E-89 as a phenolic condensation, which are available from Orient Chemical Industries, Ltd. Example products of the charging control agent further include TP-302 and TP-415 as a molybdenum complex of quarternary ammonium salt, which is available from Hodogaya Chemical, Co., Ltd., COPY CHARGE PSY VP2038 as a quarternary ammonium salt, COPY BLUE PR as a triphenyl methane derivative, and COPY CHARGE NEG VP2036 and COPY CHARGE NX VP434 as a quarternary ammonium salt, which are available from Hoechst AG, LRA-901 and LR-147 as a boron complex, which are available from Japan Carlit Co., Ltd., copper phthalocyanine, perylene, a quinacridone pigment, an azo pigment, and a high polymer having a sulfonic acid group, the carboxyl group, and a functional group such as a quaternary ammonium salt. Among the above, a substance controlling the toner to have a negative polarity is preferably used.

An amount of the charging control agent is not uniquely determined, but is determined based on the type of the binder resin, the additives used as needed, and a toner production method including a dispersion method. The amount of the charging control agent preferably ranges from about 0.1 parts by weight to about 10 parts by weight and preferably ranges from about 0.2 parts by weight to about 5 parts by weight with respect to the binder resin of about 100 parts by weight. When the amount of the charging control agent is greater than about 10 parts by weight, the toner may be overly charged. Effects of the charging control agent may decrease and the toner may be strongly electrostatically attracted to developing rollers (not shown) of the development units 4Y, 4C, 4M, and 4K (depicted in FIG. 1), resulting in a decreased fluidity of the developer and a decreased image density.

A wax having a low melting point in a range of from about 50 degrees centigrade to about 120 degrees centigrade effectively functions as a releasing agent in an interface between a fixing roller (not shown) of the fixing unit 40 (depicted in FIG. 1) and toner particles when the wax is dispersed with the binder resin. Thus, the toner can provide hot offset resistance. Namely, the releasing agent (e.g., an oil) needs not be applied to the fixing roller. Examples of the wax include vegetable waxes (e.g., carnauba wax, cotton wax, Japan wax, rice wax, and/or the like), animal waxes (e.g., yellow beeswax, lanolin, and/or the like), mineral waxes (e.g., ozokerite, selsyn, and/or the like), and/or petroleum waxes (e.g., paraffin, microcrystalline, petrolatum, and/or the like). In addition to the above-described natural waxes, examples of the wax further include synthetic hydrocarbon waxes (e.g., Fischer-Tropsch wax, polyethylene wax, and/or the like) and/or synthetic waxes (e.g., ester, ketone, ether, and/or the like). Examples of the wax further include fatty acid amides (e.g., 12-hydroxy amide stearate, amide stearate, imide phthalate anhydride, chlorinated hydrocarbon, and/or the like), and/or crystalline polymers having a long alkyl group as a side chain (e.g., a homopolymer and a copolymer of polyacrylate, that is, crystalline high polymer resins having a low molecular weight, such as poly-n-stearyl methacrylate and poly-n-lauryl methacrylate, and/or the like). Examples of the copolymer of polyacrylate include a copolymer of n-stearyl acrylate-ethyl methacrylate. The charging control agent and the releasing agent may be melted, mixed, and kneaded with the master batch and the binder resin. The charging control agent and the releasing agent may also be dissolved and dispersed in an organic solvent.

Inorganic fine particles can be preferably used as an additive for supporting fluidity, developing property, and chargeability of toner particles. A primary particle size of the inorganic fine particle preferably ranges from about $5\times10^{-3}$ μm to about 2 μm and more preferably ranges from about $5\times10^{-3}$ μm to about 0.5 μm. A specific surface area measured in a BET (Brunauer, Emmet, Teller) method preferably ranges from about 20 $m^2/g$ to about 500 $m^2/g$. The organic fine particles used in the toner preferably occupy from about 0.01 weight percent to about 5.0 weight percent and more preferably occupy from about 0.01 weight percent to about 2.0 weight percent. Examples of the inorganic fine particles include silica, alumina, titanium oxide, barium titanate, magnesium titanate, calcium titanate, strontium titanate, zinc oxide, tin oxide, quartz sand, clay, mica, sandlime, diatom earth, chromium oxide, cerium oxide, colcothar, antimony trioxide, magnesium oxide, zirconium oxide, barium sulfate, barium carbonate, calcium carbonate, silicon carbide, and/or silicon nitride. A combination of hydrophobic silica fine particles and hydrophobic titanium oxide fine particles is preferably used as an additive for supporting fluidity. When the hydrophobic silica fine particles and the hydrophobic titanium oxide fine particles having an average particle size of not greater than about $5\times10^{-2}$ μm are mixed and agitated, an electrostatic force and a van der Waals force between the fine particles and toner particles substantially increase. Thus, even when the fine particles and the toner particles are mixed and agitated in the development units 4Y, 4C, 4M, and 4K (depicted in FIG. 1) to charge the toner particles up to a desired charging level, the additive for supporting fluidity may not separate from the toner particles, resulting in a high quality image and a reduced amount of residual toners remaining on the photoconductors 1Y, 1C, 1M, and 1K (depicted in FIG. 1) after toner images are transferred from the photoconductors 1Y, 1C, 1M, and 1K onto the intermediate transfer belt 31 (depicted in FIG. 1). Titanium oxide fine particles may provide an improved environmental stability and an improved image density stability. However, titanium oxide fine particles may provide a decreased charging property. Therefore, when the amount of titanium oxide fine particles exceeds the amount of silica fine particles, titanium oxide fine particles may not be easily charged. When hydrophobic titanium oxide fine particles and hydrophobic silica fine particles are added to occupy from about 0.3 weight percent to about 1.5 weight percent, hydrophobic titanium oxide fine particles may provide a desired charging property. Namely, even when a copying operation is repeated, the image forming apparatus 100 (depicted in FIG. 1) can provide a stable image quality.

The following describes a production method of a toner according to this non-limiting exemplary embodiment. However, the production method of the toner is not limited to the method described below.

As a first step, a colorant, an unmodified polyester, a polyester prepolymer having an isocyanate group, and a releasing agent are dispersed in an organic solvent to produce a toner material liquid. The organic solvent preferably includes a volatile solvent having a boiling point lower than about 100 degrees centigrade, so that the organic solvent is easily removed after toner particles are formed. Examples of the organic solvent include a single substance (e.g., toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and/or the like) and/or a mixture of two or more of the above substances. Examples of the organic solvent preferably include aromatic solvents (e.g., toluene, xylene, and/or the like) and/or halogenated hydrocarbons (e.g., methylene chloride, 1,2-dichloroethane, chloroform, carbon tetrachloride, and/or the like). An amount of the organic solvent corresponding to 100 parts by weight of the polyester prepolymer usually ranges from about 0 parts by weight to about 300 parts by weight, preferably ranges from about 0 parts by weight to about 100 parts by weight, and more preferably ranges from about 25 parts by weight to about 70 parts by weight.

As a second step, the toner material liquid is emulsified in an aqueous medium in the presence of a surfactant and resin fine particles to produce an emulsified liquid. The aqueous medium may include water only or may include water and an organic solvent. Examples of the organic solvent include alcohols (e.g., methanol, isopropyl alcohol, ethylene glycol, and/or the like), dimethylformamide, tetrahydrofuran, cellosolves (e.g., methyl cellosolve and/or the like), and/or lower ketones (e.g., acetone, methyl ethyl ketone, and/or the like).

An amount of the aqueous medium corresponding to 100 parts by weight of the toner material liquid usually ranges from about 50 parts by weight to about 2,000 parts by weight and preferably ranges from about 100 parts by weight to about 1,000 parts by weight. When the amount of the aqueous medium is less than about 50 parts by weight, the toner material liquid may not be properly dispersed and toner particles having a predetermined particle size may not be obtained. When the amount of the aqueous medium is more than about 2,000 parts by weight, toner particles may not be produced at a reasonable cost. To properly disperse the toner material liquid in the aqueous medium, a dispersing agent (e.g., a surfactant, resin fine particles, and/or the like) can be added as needed.

Examples of the surfactant include anionic surfactants (e.g., alkyl benzene sulfonate, α-olefin sulfonate, ester phosphate, and/or the like), amine salt cationic surfactants (e.g., alkylamine salt, amino alcohol fatty acid derivative, polyamine fatty acid derivative, imidazoline, and/or the like), quaternary ammonium salt cationic surfactants (e.g., alkyl trimethyl ammonium salt, dialkyl dimethyl ammonium salt, alkyl dimethyl benzyl ammonium salt, pyridinium salt, alkyl isoquinolinium salt, benzethonium chloride, and/or the like), nonionic surfactants (e.g., fatty acid amide derivative, polyalcohol derivative, and/or the like), and/or amphoteric surfactants (e.g., alanine, dodecyldi(aminoethyl)glycin, di(octyl aminoethyl)glycin, N-alkyl-N,N-dimethyl ammonium betaine, and/or the like).

A small amount of a surfactant having a fluoroalkyl group can be effectively used according to this non-limiting exemplary embodiment. Examples of the preferred anionic surfactant having the fluoroalkyl group include a fluoroalkyl carboxylic acid having a carbon number of 2 to 10 and a metallic salt thereof, disodium perfluorooctane sulfonylglutamate, sodium 3-[omega-fluoroalkyl(C6 to C11)oxy]-1-alkyl(C3 to C4)sulfonate, sodium 3-[omega-fluoro alkanoyl(C6 to C8)-N-ethylamino]-1-propanesulfonate, a fluoroalkyl(C11 to C20)carboxylic acid and a metallic salt thereof, a perfluoro alkyl carboxylic acid (C7 to C13) and a metallic salt thereof, perfluoro alkyl(C4 to C12)sulfonate and a metallic salt thereof, perfluorooctane diethanolamide sulfonate, N-propyl-N-(2 hydroxyethyl)perfluorooctane sulfonamide, a perfluoro alkyl(C6 to C10)sulfonamide propyl trimethyl ammonium salt, a perfluoro alkyl(C6 to C10)-N-ethyl sulfonyl glycin salt, and/or monoperfluoro alkyl(C6 to C16)ethyl ester phosphate.

Example products of the anionic surfactant include Surflon S-111, S-112, and S-113 available from Asahi Glass Co., Ltd., Fluorad FC-93, FC-95, FC-98, and FC-129 available from Sumitomo 3M Limited, Unidyne DS-101 and DS-102 available from Daikin Industries, Ltd., Megaface F-110, F-120, F-113, F-191, F-812, and F-833 available from Dainippon Ink and Chemicals, Incorporated, EFTOP EF-102, EF-103, EF-104, EF-105, EF-112, EF-123A, EF-123B, EF-306A, EF-501, EF-201, and EF-204 available from JEMCO Inc., and FTERGENT F-100 and F-150 available from NEOS Company Limited.

Examples of the cationic surfactant include primary, secondary, and tertiary aliphatic amic acids, aliphatic, quaternary ammonium salts (e.g., perfluoroalkyl(C6 to C10)sulfonamide propyl trimethyl ammonium salt and/or the like), a benzalkonium salt, benzethonium chloride, a pyridinium salt, and/or an imidazolinium salt. All of the above have the fluoroalkyl group. Example products of the cationic surfactant include Surflon S-121 available from Asahi Glass Co., Ltd., Fluorad FC-135 available from Sumitomo 3M Limited, Unidyne DS-202 available from Daikin Industries, Ltd., Megaface F-150 and F-824 available from Dainippon Ink and Chemicals, Incorporated, EFTOP EF-132 available from JEMCO Inc., and FTERGENT F-300 available from NEOS Company Limited.

Resin fine particles are added to stabilize toner particles formed in the aqueous medium. Therefore, the resin fine particles may be preferably added so that the resin fine particles cover the surface of a toner particle at a coverage ratio ranging from about 10 percent to about 90 percent. Examples of the resin fine particles include polymethyl methacrylate fine particles having a particle size of about 1 μm or about 3 μm, polystyrene fine particles having a particle size of about 0.5 μm or about 2 μm, and/or poly (styrene-acrylonitrile) fine particles having a particle size of about 1 μm. Example products of the resin fine particles include PB-200H available from Kao Corporation, SGP available from Soukensha, Techpolymer SB available from Sekisui Plastics Co., Ltd., SGP-3G available from Soukensha, and Micropearl available from Sekisui Chemical Co., Ltd.

An inorganic compound dispersing agent can be added in the aqueous medium. Examples of the inorganic compound dispersing agent include tricalcium phosphate, calcium carbonate, titanium oxide, colloidal silica, and/or hydroxy apatite. A high polymer protective colloid may be used as a dispersing agent, which can be used with the resin fine particles and the inorganic compound dispersing agent, so as to stabilize a dispersed liquid droplet. Examples of the high polymer protective colloid include acids (e.g., acrylic acid, methacrylic acid, α-cyanoacrylic acid, α-cyanomethacrylic acid, itaconic acid, crotonic acid, fumaric acid, maleic acid, maleic anhydride, and/or the like), acrylic or methacrylic monomers having the hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerin monoacrylic ester, glycerin monomethacrylic ester, N-methylolacrylamide, N-methylolmethacrylamide, and/or the like), a vinyl alcohol and ethers thereof (e.g., vinyl methyl ether, vinyl ethyl ether, vinyl propyl ether, and/or the like), an ester of vinyl alcohol and compounds having the carboxyl group (e.g., vinyl acetate, vinyl propionate, vinyl butyrate, and/or the like), acrylamide, methacrylamide, diacetone acrylamide, and a methylol compound thereof, acid chlorides (e.g., acrylic acid chloride, methacrylic acid chloride, and/or the like), nitrogen compounds (e.g., vinyl pyridine, vinyl pyrrolidone, vinyl imidazole, ethyleneimine, and/or the like), homopolymers and copolymers (e.g., a heterocyclic nitrogen compound and/or the like), polyoxyethylene compounds (e.g., polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, polyoxyethylene nonylphenylester, and/or the like), and/or cellulose compounds (e.g., methyl cellulose, hydroxyethyl cellulose, hydroxypropyl cellulose, and/or the like).

A dispersion method is not limited and known dispersion devices using a low-speed shearing, a high-speed shearing, a friction, a high-pressure jet, and a ultrasonic methods can be used as a dispersion device. The high-speed shearing method can be preferably used to produce a dispersion particle having a particle size ranging from about 2 μm to about 20 μm. The number of rotations of the dispersion device using the high-speed shearing method is not restricted, but usually ranges from about 1,000 rpm to about 30,000 rpm and preferably ranges from about 5,000 rpm to about 20,000 rpm. A dispersion time period is not restricted, but usually ranges from about 0.1 minute to about 5 minutes for a batch method. A dispersion temperature usually ranges from about 0 degrees centigrade to about 150 degrees centigrade under pressure and preferably ranges from about 40 degrees centigrade to about 98 degrees centigrade.

As a third step, when the emulsified liquid is produced, the amine (B) is added to cause a reaction with the polyester prepolymer (A) having the isocyanate group. The reaction includes cross-linking and/or elongation of a molecular chain. The reaction time period may vary depending on the reaction of the isocyanate group of the polyester prepolymer (A) with the amine (B). For example, the reaction time period usually ranges from about 10 minutes to about 40 hours and preferably ranges from about 2 hours to about 24 hours. The reaction temperature usually ranges from about 0 degrees centigrade to about 150 degrees centigrade and preferably ranges from about 40 degrees centigrade to about 98 degrees centigrade. A known catalyst may be used as needed. Examples of the catalyst include dibutyltin laurate and/or dioctyltin laurate.

As a fourth step, when the reaction is finished, the organic solvent is removed from the emulsified and dispersed liquid, washed, and dried to produce toner particles. Specifically, the emulsified and dispersed liquid is gradually heated while agitated in a laminar flow. When the emulsified and dispersed liquid is heated up to a predetermined temperature range, the emulsified and dispersed liquid is strongly agitated. The organic solvent is removed to produce toner particles having a spindle shape. When a substance soluble in an acid or an alkali, such as a calcium phosphate salt, is used as a dispersion stabilizing agent, the calcium phosphate salt is dissolved with an acid (e.g., a hydrochloric acid and/or the like). The calcium phosphate salt is removed from toner particles by washing, for example. The calcium phosphate salt can also be removed by enzymatic breakdown.

As a fifth step, the charging control agent is added to the toner particles produced as described above. Then, inorganic fine particles (e.g., silica fine particles, titanium oxide fine particles, and/or the like) are added to produce a toner. The charging control agent and the inorganic fine particles are added by a known method using a mixer and/or the like. Thus, a toner having a small size and a sharp particle size distribution can be easily produced. The emulsified and dispersed liquid is strongly agitated in a process for removing the organic solvent. Thus, the toner particles can have a shape ranging from a sphere shape to a spindle shape. The toner particles can also have a surface ranging from a smooth surface to a wrinkly surface.

Figure 10A:
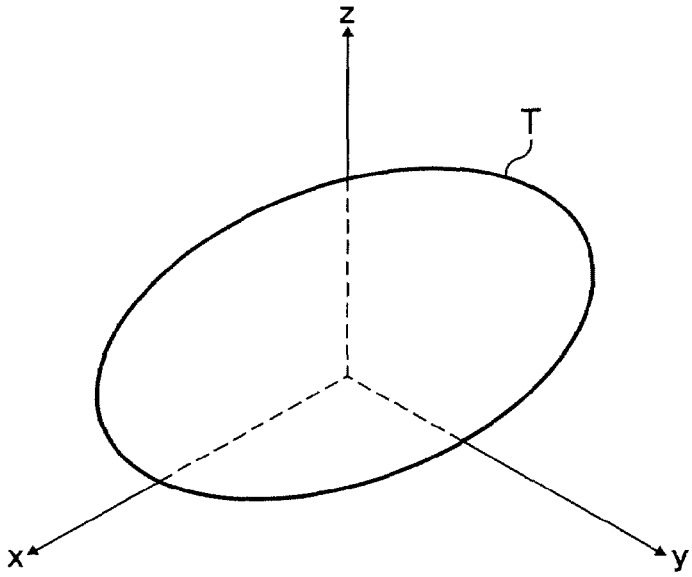
FIG. 10A is an illustration of a toner particle according to an exemplary embodiment of the present invention.
Figure 10B:
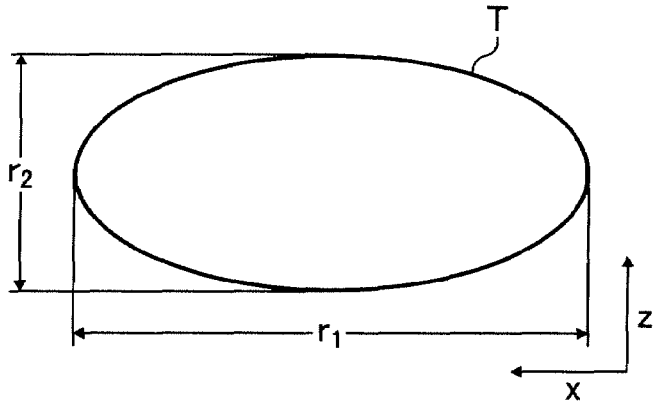
FIG. 10B is a front view of the toner particle shown in FIG. 10A.
Figure 10C:
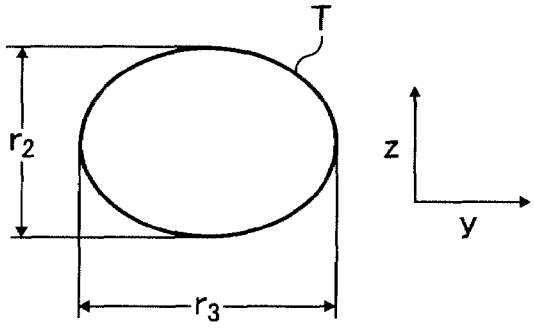
FIG. 10C is a side view of the toner particle shown in FIG. 10A.

Referring to FIGS. 10A, 10B, and 10C, the following describes the shape of a toner particle T according to this non-limiting exemplary embodiment. As illustrated in FIG. 10A, the toner particle T according to this non-limiting exemplary embodiment has a substantially spherical shape. In FIGS. 10B and 10C, a long diameter r1 represents the longer diameter of the toner particle T. A short diameter r2 represents the shorter diameter of the toner particle T. A thickness r3 represents the thickness of the toner particle T. The long diameter r1 is equal to or is longer than the short diameter r2. The short diameter r2 is equal to or is longer than the thickness r3. As illustrated in FIG. 10B, a ratio r2/r1 of the short diameter r2 to the long diameter r1 preferably ranges from about 0.5 to about 1.0. As illustrated in FIG. 10C, a ratio r3/r2 of the thickness r3 to the short diameter r2 preferably ranges from about 0.7 to about 1.0. When the ratio r2/r1 is smaller than about 0.5, the shape of the toner particle T may deviate from the spherical shape. Thus, the toner particle T may provide a decreased dot generation and a decreased transfer efficiency, resulting in a deteriorated image quality. When the ratio r3/r2 is smaller than about 0.7, the toner particle T may have a flat shape and thereby may not provide a high transfer rate provided when the toner particle T has a spherical shape. When the ratio r3/r2 is about 1.0, the toner particle T rotates around the long diameter r1 as a rotation axis, providing an increased fluidity. The long diameter r1, the short diameter r2, and the thickness r3 were measured by photographing the toner particle T from different angles while the toner particle T was observed with a scanning electron microscope (SEM).

A toner produced as described above can be used as a one-component magnetic toner without magnetic carriers or a non-magnetic toner. When the toner is used as a two-component developer, the toner may be mixed with magnetic carriers. The magnetic carriers preferably include ferrite including a divalent metal (e.g., iron, magnetite, manganese, zinc, copper, and/or the like) and preferably have a volume average particle size ranging from about 20 μm to about 100 μm. When the volume average particle size is smaller than about 20 μm, the magnetic carriers may be easily adhered to the photoconductors 1Y, 1C, 1M, and 1K (depicted in FIG. 1) while an electrostatic latent image is developed with the toner. When the volume average particle size is greater than about 100 μm, the magnetic carriers may not be easily mixed with the toner and thereby the toner may not be properly charged when the image forming apparatus 100 (depicted in FIG. 1) is continuously used. Copper ferrite including zinc is preferably used because copper ferrite provides an increased saturated magnetization. However, the magnetic carriers may include other substances selected in accordance with a process performed by the image forming apparatus 100.

A resin for covering the magnetic carriers is not limited. However, examples of the resin include a silicone resin, a styrene-acrylic resin, fluoroplastic, and/or an olefin resin. To cover the magnetic carriers with a resin, a coating resin may be dissolved in a solvent, sprayed in a fluid layer, and coated on a core. Alternatively, resin particles may be electrostatically adhered to core particles and melted by heat. The thickness of the resin covering the magnetic carriers ranges from about 0.05 μm to about 10 μm and preferably ranges from about 0.3 μm to about 4 μm.

The present invention has been described above with reference to specific exemplary embodiments. Note that the present invention is not limited to the details of the exemplary embodiments described above, but various modifications and enhancements are possible without departing from the spirit and scope of the invention. It is therefore to be understood that the present invention may be practiced otherwise than as specifically described herein. For example, elements and/or features of different exemplary embodiments may be combined with each other and/or substituted for each other within the scope of the present invention.

What is claimed is:

1. An image forming apparatus, comprising:

a photoconductor configured to carry a toner image formed by developing an electrostatic latent image with a toner; and a lubricant applicator configured to apply a solid lubricant to a surface of the photoconductor, the lubricant applicator including a holder configured to hold the solid lubricant, a brush roller configured to scrape off the solid lubricant from the holder and apply the scraped solid lubricant to the surface of the photoconductor, a pressing member having an ellipse shape and configured to press the solid lubricant toward the brush roller via the holder, and a major axis of the ellipse shape is larger than a minor axis of the ellipse shape, and a protrusion disposed on the holder and configured to contact an inner circumferential surface of the pressing member at two discrete positions provided in both end portions of the pressing member in a direction of the minor axis of the ellipse shape formed by the pressing member so as to support the pressing member.

2. The image forming apparatus according to claim 1, wherein the solid lubricant has a bar shape.

3. The image forming apparatus according to claim 1, wherein the pressing member includes a compression spring.

4. The image forming apparatus according to claim 1, wherein the protrusion has a cylindrical shape.

5. The image forming apparatus according to claim 1, wherein the protrusion has a cylindroid shape, and a length of a major axis of an ellipse formed by the protrusion is shorter than an inner diameter in a direction of the major axis of the ellipse shape formed by the pressing member.

6. The image forming apparatus according to claim 1, wherein the holder includes a metal sheet and is embossed to form the protrusion.

7. The image forming apparatus according to claim 1, wherein the holder includes a resin and is integrally molded with the protrusion.

8. The image forming apparatus according to claim 1, wherein the protrusion includes a tapered head portion.

9. The image forming apparatus according to claim 1, wherein the protrusion includes a head portion having a conical shape.

10. The image forming apparatus according to claim 1, wherein the protrusion includes a head portion having a hemispherical shape.

11. The image forming apparatus according to claim 1, wherein the solid lubricant includes zinc stearate.

12. The image forming apparatus according to claim 1, further comprising:

a process cartridge, including the photoconductor and the lubricant applicator, configured to attach and detach from the image forming apparatus.

13. A lubricant applicator for applying a solid lubricant to a surface of a photoconductor, comprising:

a holder configured to hold the solid lubricant;

a brush roller configured to scrape off the solid lubricant from the holder and apply the scraped solid lubricant to the surface of the photoconductor;

a pressing member having an ellipse shape and configured to press the solid lubricant toward the brush roller via the holder, and a major axis of the ellipse shape is larger than a minor axis of the ellipse shape; and a protrusion disposed on the holder and configured to contact an inner circumferential surface of the pressing member at two discrete positions provided in both end portions of the pressing member in a direction of the minor axis of the ellipse shape formed by the pressing member so as to support the pressing member.

14. The lubricant applicator according to claim 13, wherein the pressing member includes a compression spring.

15. The lubricant applicator according to claim 13, wherein the protrusion has a cylindrical shape.

16. The lubricant applicator according to claim 13, wherein the protrusion has a cylindroid shape, and a length of a major axis of an ellipse formed by the protrusion is shorter than an inner diameter in a direction of the major axis of the ellipse shape formed by the pressing member.

* * * * *